United States Patent [19]

Kolkman

[11] 4,059,845

[45] Nov. 22, 1977

[54] FAIL-SAFE TIME DELAY CIRCUIT

[75] Inventor: Dick J. Kolkman, Gibsonia, Pa.

[73] Assignee: Westinghouse Air Brake Company, Swissvale, Pa.

[21] Appl. No.: 686,304

[22] Filed: May 14, 1976

[51] Int. Cl.[2] ..... H01H 47/18

[52] U.S. Cl. ..... 361/198; 361/203; 361/205

[58] Field of Search ..... 317/141 S, 141 R, 146, 317/148.5 R; 361/196, 198, 203, 205

[56] References Cited

U.S. PATENT DOCUMENTS

| | | | |
|---|---|---|---|
| 3,407,340 | 10/1968 | Hofnagel | 317/141 S |
| 3,411,020 | 11/1968 | Lake | 317/141 S X |
| 3,694,702 | 9/1972 | Popp | 317/141 S |
| 3,873,893 | 3/1975 | Bianchini | 317/141 S |

*Primary Examiner*—Harry E. Moose, Jr.
*Attorney, Agent, or Firm*—J. B. Sotak; R. W. McIntire, Jr.

[57] ABSTRACT

A fail-safe time delay circuit comprising a detection relay for sensing the presence and absence of an input signal, a switching relay for assuming a first and a second condition in accordance with the presence and absence of the input signal, and a programmable unijunction transistor oscillating circuit, a silicon controlled rectifier gating circuit and a d.c. making circuit including a solid-state Colpitts oscillator and half-wave rectifier controlled by the second condition of the switching relay for providing a predetermined time delay period between the disappearance and the reappearance of the input signal prior to permitting the switching relay reassume its first condition.

10 Claims, 1 Drawing Figure

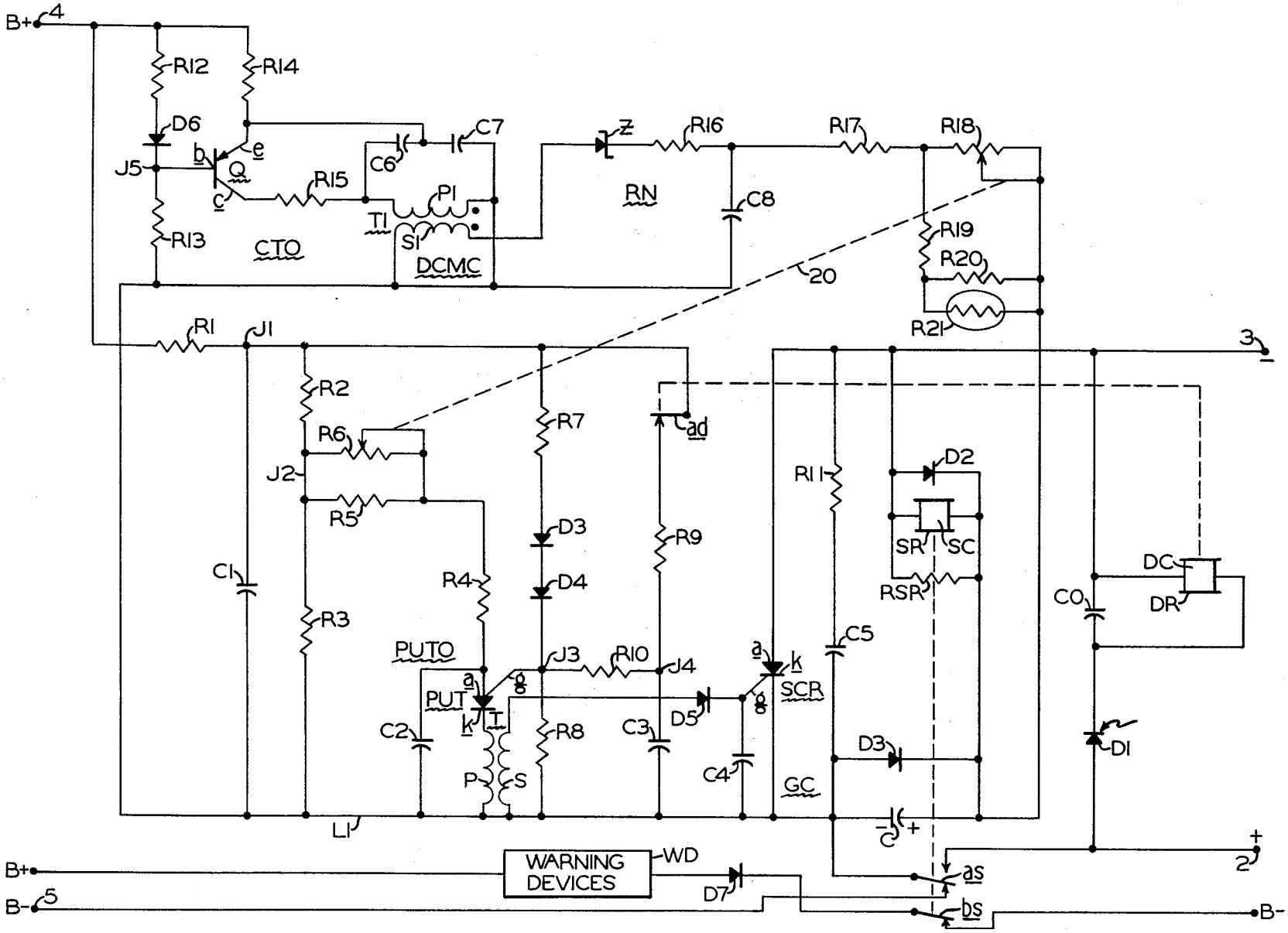
WARNING DEVICES
RN
DCMC
CTO
PUTO
GC
SCR
PUT
B+
B-

FAIL-SAFE TIME DELAY CIRCUIT

FIELD OF THE INVENTION

This invention relates to a vital type of time delay circuit, and more particularly, to a fail-safe timer employing a detection relay for sensing the presence and absence of an input signal, a switching relay for assuming a first and a second condition in accordance with the presence and absence of the input signal and associated electronic oscillating, gating and d. c. making circuits controlled by the second condition of the switching relay for providing a time delay period between the disappearance and the reappearance of the input signal prior to the switching relay reassuming the first condition.

BACKGROUND OF THE INVENTION

In certain railroad highway grade crossing protection equipment, such as, in a fail-safe vehicle motion monitoring system, it is essential that the traffic and pedestrian warning signals and devices should not be capable of being deactivated when a moving train is approaching the highway or roadway crossing. It has been found that under certain unusual and adverse circumstances that the protection equipment may momentarily lose an approaching train. For example, it is possible to temporarily interrupt the warning devices, such as, the flashing lights at the highway grade crossing when a loss of the shunt by the wheels and axles causes the motion monitoring relay to become momentarily picked up and released. A similar situation occurs when a slowly approaching train enters the detection zone and encounters a bad bond within the detection zone which results in the temporary interruption of the flashing crossing relays and lights. In each case, the momentary loss is due to the fact that the reflected inpedance versus the track distance characteristic curve will undergo a downward step function which tends to cause an inflection of the change in the rate of the impedance and to simulate a slow to fast and then back to slow again approaching movement. It will be appreciated that while these momentary interruptions in the flashing lights do not effect the reliability of the protection system, it gives signal supervisors and engineers an uneasy feeling since they are accustomed to continuous operation of the warning devices. In order to alleviate the apprehensiveness of the signal personnel, it is simply necessary to supplement the fail-safe motion monitoring equipment with a suitable vital type of time delay circuit.

Accordingly, it is an object of this invention to provide a fail-safe time delay circuit for supplementing a railroad highway grade crossing motion monitoring apparatus.

Another object of this invention is to provide a vital type of time delay circuit for providing a time delay period for a motion monitoring device.

A further object of this invention is to provide a fail-safe timer for preventing a relay from picking up and dropping out due to the momentary appearance of an input signal.

Yet another object of this invention is to provide a unique timing circuit employing a pair of R-C networks for delaying the immediate energization of signal responsive device.

Yet a further object of this invention is to provide a novel time delay circuit having a detection relay for sensing the presence and absence of an input signal, a switching relay for assuming a picked-up and dropped-out condition in response to the presence and the absence of the input signal and associated electronic oscillating, gating and d. c. making circuits governed by the switching relay for providing a time delay period between the disappearance and the reappearance of the input signal prior to causing the pick up of the switching relay.

Still another object of this invention is to provide a fail-safe time delay circuit employing detection means for sensing the presence and absence of an input signal on a pair of terminals, switching means connectable between the pair of input signal terminals and a pair of d. c. supply terminals, the switching means assuming a first and a second condition in accordance with the presence and absence of the input signal on the input signal terminals, and associated oscillating, gating and d. c. making means controlled by the second condition of the switching means for providing a time delay period between the disappearance and the reappearance of the input signal on the pair of input signal terminals prior to the switching means reassuming the first condition.

Still a further object of this invention is to provide a new and improved fail-safe timer which is economical in cost, simple in construction, reliable in operation, durable in use and dependable in service.

SUMMARY OF THE INVENTION

In accordance with the present invention there is provided a fail-safe time delay circuit employing a detection relay having a coil connected to a pair of input signal terminals for sensing the presence and absence of an input signal and having a back inhibiting contact. A switching relay having a coil is connectable to the pair of input signal terminals and to a pair of d. c. supply terminals over a front and a back contact, respectively. The switching relay is picked-up and dropped-out in accordance with the presence and absence of the input signal on the pair of input signal terminals. An oscillating circuit includes a programmable unijunction transistor having a cathode, anode and a gate electrode. A current-limiting resistor-capacitor type of filter or decoupling network is connectable across the terminals to the d. c. supply voltage via the back contact of the switching relay. A voltage divider is connected across the capacitor of the decoupling network. A series connected resistance-capacitance timing circuit is coupled to the anode-cathode electrodes of the programmable unijunction transistor. The gate electrode is connected to the junction point of a temperature compensating voltage dividing network and is connected by a coupling resistor to the junction point of a series connected capacitor and resistor which, in turn, is coupled to the back inhibit contact of the detection relay. A gate electrode of a gating circuit including a silicon controlled rectifier is transformer coupled to the output of the programmable unijunction transistor oscillating circuit. The anode and cathode electrodes of the SCR is connected in series with the coil of the switching relay and a charging capacitor. A d. c. making circuit is connectable to the pair of d. c. supply terminals. The d. c. making circuit includes a transistorized Colpitts oscillator which transformer couples a. c. oscillations to a rectifier network. The output of the rectifier network is resistively coupled to the charging capacitor which forms an R-C timing circuit with an appropriate resistance.

The resistor of the R-C timing circuit is ganged to the resistance of the resistance-capacitance timing circuit of the programmable unijunction transistor oscillator. In operation, the coils of the detection and switching relays are energized by the presence of the input voltage appearing on the pair of input signal terminals when the detection track section or zone preceding the grade crossing is unoccupied. Under this condition, the oscillating, gating and d. c. making circuits are dormant due to the lack of d. c. supply voltage in view of the open back contact of the switching relay. However, when a train or vehicle enters the track section, the front wheels and axle shunt the rails and cause the disappearance of the input signal on the pair of input signal terminals. The absence of the input signal causes the deenergization of the detection and switching relays. The drop-out of the relays results in the closing of the back contacts of both relays. The closed back contact of the switching relay causes the application of d. c. operating voltage to the oscillating, gating and d. c. making circuits. Thus, the Colpitts oscillator begins to produce a. c. oscillations which are rectified by the rectifier network so that the charging capacitor of the R-C time circuit begins to charge through its associated resistance. At the same time, the charge on the capacitor of the series connected resistance-capacitance timing circuit begins to increase so that the voltage on the anode electrode of the programmable unijunction transistor increases. With the back contact of the detection relay closed, the unijunction transistor is inhibited from conducting since the potential charge on the anode electrode cannot exceed the potential on the gate electrode. However, in the interim, if the input signal reappears on the input signal terminals, the detection relay will become picked up and will open the back inhibiting contact. This causes the potential on the gate electrode to be lowered so that after a predetermined time period, which in effect, is the R-C time constant, the potential on the anode electrode will become sufficient to exceed the gate electrode so that the unijunction transistor will fire. The firing of the unijunction transistor causes a triggering pulse to be transformer coupled to the gate electrode of the SCR so that it is rendered conductive. The conduction of the SCR establishes a discharge circuit path for the charged capacitor through the coil of the switching relay. Thus, the switching relay becomes energized and picks up so that its back contact opens and its front contact closes. The switching relay will remain picked-up by the presence of the input signal on the pair of input signal terminals. Ergo, the present fail-safe time delay circuit provides a given time delay period between the disappearance and the reappearance of the input signal on the pair of input terminals so that the momentary loss of the input signal does not result in the inadvertent interruption of the warning devices, such as, flashing lights, bells, horns, or the like, at a railroad highway grade crossing.

BRIEF DESCRIPTION OF THE DRAWING

The foregoing objects and other attendant features and advantages will be more readily apparent and appreciated as the subject invention becomes more fully and clearly understood by reference to the following detailed description when considered in conjunction with the accompanying drawing wherein:

The single FIGURE of the drawing illustrates a schematic circuit diagram of the fail-safe time delay circuit arrangement in accordance with the present invention.

Referring now to the single or sole FIGURE of the drawing, there is shown a preferred embodiment of the vital or fail-safe time circuit which is not presently characterized by any particular numeral. As shown, the fail-safe timer includes a detection relay DR, a switching relay SR, a programmable unijunction transistor oscillator PUTO, a gating circuit GC and a d. c. making circuit DCMC.

In a railroad highway grade crossing application, the input signal from the motion monitoring equipment is applied to the pair of input terminals 2 and 3 and is polarized in the manner as shown in the drawing.

The detection relay or means includes an electromagnetic coil DC and an appropriated back inhibiting contact which is opened and closed by movable contact member *ad*, the purpose of which will be described in greater detail hereinafter. One end of coil DC is connected to the positive input terminal 2 via a light emitting diode D1 which also serves a blocking diode while the other end of coil DC is directly connected to the negative input terminal 3. As shown connected across coil DC is a capacitor CO which suppresses most of the high frequency signal that appears across the input terminals 2 and 3.

The switching relay or means SR includes an appropriate electromagnetic coil SC and a front contact and a pair of back contacts which are opened and closed by movable contact members *as* and *bs*. A surge suppressing diode D2 is connected across coil SC. Also, a resistor RSR is connected across coil SC. The resistor RSR is utilized to ensure that a solid-state gate element, to be described later, does not turn off when current starts to flow in the discharge path to coil SC. One end of coil SC is directly connected to the negative input terminal 3 while the other end of coil SC is connected to one plate or end of charging capacitor C. The other plate or end of capacitor C is connected to movable contact as of relay SR. A suitably polarized diode D3 is connected in parallel with capacitor C, the details of which will be described hereinafter.

As shown, a pair of d. c. supply terminals 4 and 5 are connected to the B+ and B− terminals, respectively, of a suitable d. c. supply or operating voltage (not shown). A current limiting resistor R1 and a filtering capacitor C1 is coupled from the positive supply terminal 4 and a common lead L1.

As previously mentioned, the oscillating circuit or means includes a programmable unijunction transistor PUT having a cathode electrode *k*, an anode electrode *a* and a gate electrode *g*. A voltage divider including series connected resistors R2 and R3 is connected from the junction point J1 of resistor R1 and capacitor C1 to common lead L1. The anode electrode *a* of transistor PUT is connected to the junction point J2 of voltage dividing resistors R2 and R3 via series-parallel connected resistors R4, R5 and variable resistor or potentiometer R6. A capacitor C2 is connected between the anode electrode *a* and common lead L1 and forms an RC timing circuit with resistors R4, R5 and R6, as will be described hereinafter. It will be seen that the gate electrode *g* is connected to the junction point J3 of a voltage divider network formed by series connected resistor R7, negative temperature coefficient diodes D3 and D4 and resistor R8. The junction point J3 is connected to the junction point J4 of series connected resistor R9 and capacitor C3 via resistor R10. It will be noted that the upper end of resistor R9 is connected to the back inhibiting contact of detection relay DR which is opened and closed by movable contact member *ad* in accordance with the energization and deenergization of switching relay coil DC. The capacitor C3 prevents misfiring or premature firing of transistor PUT by the chattering action of contact *ad.* The output triggering pulses from oscillating circuit PUTO are derived from the cathode electrode *k* of the programmable unijunction transistor PUT and are transformer coupled to the input of the gating circuit GC.

As shown, the primary winding P of transformer T is connected between the cathode electrode *k* and the common lead L1. Thus pulses are induced into the secondary winding S which is coupled between common lead L1 to the input of a silicon controlled rectifier SCR. The silicon control rectifier SCR is the gate element which provides a discharge circuit path for the charge capacitor C, as will be described hereinafter. The silicon controlled rectifier SCR includes an anode electrode *a,* a cathode electrode *k* and a gate electrode *g.* It will be seen that the upper end of secondary winding S is coupled to the gate electrode *g* of rectifier SCR via blocking diode D5. Further, the gate electrode *g* is also connected to common lead L1 via noise by-pass capacitor C4. As shown, the anode electrode *a* of rectifier SCR is directly connected to the upper end of coil SC while the cathode electrode *k* is connected to the other plate or end of charging capacitor C. A series connected resistor R11 and capacitor C5 is coupled between terminal 3 and common lead L1.

The d. c. making circuit DCMC includes a Colpitts transistor oscillator circuit CTO and a half-wave rectifier network RN. The oscillator circuit includes a PNP transistor Q having an emitter electrode *e,* a base electrode *b* and a collector electrode *c.* The base electrode *b* is connected to the junction point J5 of a voltage divider including resistor R12, diode D6 and resistor R13. The upper end of resistor R12 is connected to positive voltage terminal 4 while the lower end of resistor R13 is connected to common lead L1. The emitter electrode *e* is connected to the positive supply terminal 4 via swamping resistor R14. The collector electrode *c* is connected by resistor R15 to a tank circuit formed by primary winding P1 of transformer T1 and capacitors C6 and C7 which constitute the frequency determining components of the oscillator. The capacitors C6 and C7 form a voltage divider network, and the junction point between the capacitors is connected to the emitter electrode *e* of transistor Q. The remote ends of capacitor C7 and primary winding P1 are directly connected to the common lead L1. The a. c. oscillations developed in primary winding P1 are induced into the secondary winding S1 of transformer T1. The a. c. oscillations developed in secondary winding S1 are fed to the half-wave rectifier network RN. As shown, one end of the secondary winding S1 is directly connected to common lead L1 while the other end of secondary winding S1 is connected to the anode electrode of Zener diode Z. The cathode electrode of Zener diode Z is connected to one end of current limiting resistor R16 while the other end of resistor R16 is connected to the upper plate of filtering capacitor C8. The lower plate of the capacitor is connected to common lead L1. The other end of resistor R16 and the upper plate of capacitor C8 are connected to series-parallel connected resistors R17 and R18, variable resistor or potentiometer R19, resistor R20 and thermistor R21. As shown by phantom line 20, the potentiometer R19 is mechanically coupled or ganged together with potentiometer R6 so that proportional variation in resistances occur when an adjustment is made. The resistors R17, R18, R19, R20 and thermistor R21 are connected to the charging capacitor C and form an R-C timing circuit having a time constant which is related to the time constant of R4, R5, R6, C2 timing circuit due to the ganged connection of resistors R6 and R18.

For the purpose of convenience, warning devices WD and a blocking diode D7 are shown connected between B+ terminal and B− terminal of a common or separate source of D. C. supply voltage over the back contact by the movable contact *bs.* Thus, the warning devices, such as, the flashing lights, bells, horns, whistles, gates or the like, are activated over the back contact of relay SR by movable contact *bs.*

In describing the operation, it will be assumed that all the elements or components are intact and functioning properly, that the d. c. supply voltage is connected to terminals 4 and 5 and that an input signal is not present on terminals 2 and 3. It also should be understood at this point in time that the D. C. supply voltage across terminals 4 and 5 will under no circumstance share the same common ground with signal terminals 2 and 3 and are completely independent of each other. Under this condition, it will be seen that the back contact of relay SR is initially closed by the movable contact *as* so that the negative B− potential is connected to common lead L1. Thus, the programmable unijunction transistor oscillating circuit PUTO and the d. c. making circuit DCMC are energized and powered by the d. c. operating potential applied to terminals 4 and 5. Further, it will be appreciated that the capacitor C2 will begin to charge through the seriesparallel connected resistors R4, R5 and R6 and will eventually reach the voltage level appearing at junction point J3. The charging rate is determined by the R-C time constant of the values of capacitor C2 and of composite resistors R4, R5, R6. The reappearance of an input signal on terminals 2 and 3 energizes coil DC of relay DR which causes its back contact to be opened by picking up movable contact *ad.*

When the back contact is opened by the disengagement of movable contact *ad,* the potential level at junction point J3 will assume a value which will result in the conduction of the transistor PUT when the voltage on the anode electrode *a* reaches a predetermined level, namely, when the voltage difference between the anode and gate junction of transistor PUT is by one diode forward voltage drop. That is, the voltage level on gate electrode *g* is determined by the ratio of R8 which is designed to be lower than the voltage appearing at junction J2. It will be appreciated that when the capacitor C2 begins to charge, the Colpitts oscillator CTO of the d. c. making circuit DCMC also starts to produce a. c. oscillation which are transformer coupled to the rectifier RN. The d. c. voltage produced by rectifier network RN begins charging the capacitor C through the series-parallel connected resistors R17, R18, R19, R20 and thermistor R21. It will be appreciated that the charging rates of capacitors C2 and C are interrelated due to the gang connection of the respective resistors R6 and R18. Now when the charge on capacitor C2 causes the voltage on anode electrode *a* to exceed the voltage on gate electrode *g,* the transistor PUT conducts and causes a voltage pulse to be developed in primary winding P which, in turn, induces a trigger pulse into secondary winding S. The trigger pulse is conveyed through diode D5 to the gate electrode *g* of silicon controlled rectifier SCR which causes it to fire.

The conduction of the SCR establishes a discharge circuit path for capacitor C through resistor RSR and inductive coil SC, through the anode-cathode electrodes *a* – *k*, back to the capacitor C so that relay SR is picked-up thereby opening its back contact and closing its front contact over movable contact *as*. With the front contact closed, the relay SR will remain energized over its stick circuit by the input signal appearing across terminals 2 and 3. The opening of the back contact by movable contact as removes the negative operating potential from the oscillating circuit PUTO and the d. c. making circuit DCMC so that they are rendered inoperative. This condition will prevail so long as no approaching train or vehicle enters the detection track section and no other event, such as, a broken lead, an open bond wire, or the like, causes the loss of the input signal on terminals 2 and 3.

Now when a train or vehicle enters the detection track section, the signal voltage normally appearing across input terminals 2 and 3 are shunted by the front wheels and axle. The absence of the input signal on terminals 2 and 3 results in the immediate deenergization and drop-out of relays DR and SR. This results in the closing of the back contacts by movable contact *ad* and *as*, *bs* of relays DR and SR, respectively. Thus, the operating voltage is reapplied through the back and movable contacts *as* to the common lead L1. This causes the capacitor C2 to begin charging through the series-parallel connected resistors R4, R5 and R6 and also results in the generation of a. c. oscillations by oscillator CTO and rectification by rectified RN so that capacitor C also begins to charge through series-parallel connected resistors R17, R18, R19, R20 and thermistor R21. If a loss of the shunting by the vehicle should occur during the charging of capacitors C2 and C, the warning devices, such as, the flashing lights or the like, at the highway crossing will not be immediately deactivated since the switching relay SR will not undergo a change of state until the elapse of a given time delay period, namely, (R4, R5, R6) (C2) which is proportional to (R17, R18, R19, R20, R21) (C). The reappearance of the input signal will cause the reenergization of relay DR so that the inhibiting back contact is opening by movable contact *ad*.

If the reappearance of the input signal is due to the train stopping well in advance of the highway crossing, the switching relay SR will become reenergized after the expiration of the RC time delay period. That is, when the potential charge on capacitor C2 exceeds the gate potential, the transistor PUT will conduct and produce a triggering pulse for firing the silicon control recitifier SCR. The firing of the SCR establishes a discharge path for capacitor C and causes the energization of relay SR. The relay SR picks up and remains picked up by the input signal on terminals 2 and 3. The picking up of the relay SR results in the opening of its back contacts which deenergizes the programmable unijunction transistor oscillator PUTO, the d. c. making circuit DCMC and the warning devices WD. This condition will remain until the input signal is again removed from terminals 2 and 3 by the start-up and advancement of the stopped train or the entrance of another train in the detection track section.

If the reappearance of the input signal is only momentary due to the temporary loss of the shunting by the approaching train, then the input signal will disappear and the detection relay DR will become deenergized and drop out. When the relay DR drops, the back inhibiting back contact will be closed by movable contact *ad*. The closing of the back contact of relay DR causes the voltage level on the gate electrode *g* to rise to a value which prevents the conduction of the transistor PUT even when the capacitor C2 becomes fully charged at the expiration of the time delay period. That is, the resistances of elements R9 and R10 are selected to be much lower than the resistive value of resistor R7 so that the potential on gate electrode *g*, will not be exceeded by the potential on the anode electrode *a* of transistor PUT. Thus, the capacitor C2 as well as capacitor C becomes fully charged but the inability of the transistor PUT to conduct prevents the silicon controlled rectifier SCR from being fired as long as an input signal does not reappear on terminals 2 and 3. Now if the train again stops well in advance of the highway crossing or when the train clears the highway crossing, the input signal voltage will once again appear on terminals 2 and 3. The reappearance of the input signal causes the energization of the detection relay DR and its picking up results in the opening of back inhibiting contact by movable contact *ad*. Thus, the biasing potential on gate electrode *g* of transistor PUT is lowered by the voltage divider network including resistors R7 and R8 so that the anode electrode *a* becomes more positive than gate electrode *g* and transistor PUT conducts. The conduction of transistor PUT results in a trigger pulse to be transformer coupled to the gate electrode *g* and the silicon controlled rectifier fires. The firing of the rectifier SCR causes the capacitor C to discharge through coil SC so that relay SR picks up. The relay SR remains energized over its stick circuit including movable contact *as* and the front contact which is connected to the input signal terminal 2. The picking up of relay SR opens the back contacts *as* and *bs* which deactivate oscillating and d. c. making circuit and the warning device WD, respectively. Thus, once the input signal on terminals 2 and 3 disappears, it is necessary that a certain time delay must elapse before the reappearance of the input signal has any effect on the operation of the warning device WD. It is quite apparent that the momentary or temporary reappearance of the input signal will not inadvertently deactivate the flashing lights, bell, horn or the like, at the railroad highway grade crossing.

As previously mentioned, the existing time delay circuit operates in a fail-safe manner in that any critical component or circuit failure results in a safe or more restrictive condition. That is, under no circumstance is it possible to decrease the time delay period by more than thirty (30) percent. For example, the programmable unijunction transistor oscillator PUTO is incapable of producing a triggering pulse when the timing capacitor C2 becomes opened or shorted. Similarly, if the charging capacitor C becomes open or short circuited, then there is no potential charge for picking up relay SR. Each of the timing resistors R4, R5, R6, R17, R18, R19 and R20 is constructed of a particular type of carbon composition which ensures that they cannot become short-circuited or decrease in value. It will be appreciated that the thermistor R21 has a slight effect on total charging current since it offsets changes in Zener voltage due to temperature variations. It is apparent the opening of any timing resistor is a safe failure which results in either an increased or an infinite time delay period. Further, any other active or passive element failure results in the elimination of the necessary triggering pulse or causes the removal of the required potential charge.

It will be appreciated that while this invention finds particular utility in a railroad highway grade crossing installation or environment, it is readily evident that the invention is not merely limited thereto but may be employed in various other apparatus and applications which have need for the security and safety inherent in the presently described fail-safe time delay circuit. But regardless of the manner in which the invention is used, it is understood that various changes and alterations may be made by persons skilled in the art without departing from the spirit and scope of this invention. It will also be apparent that other modifications and changes can be made in the presently described invention, and therefore, it is understood that all changes, modifications, and equivalents within the spirit and scope of this invention are herein meant to be covered by the appended claims.

Having now described the invention what I claim as new and desire to secure by Letters Patent, is:

1. A fail-safe time delay circuit comprising, detection means for sensing the presence and absence of an input signal on a pair of terminals, switching means connectable between said pair of input signal terminals and a pair of d.c. supply terminals, said switching means assuming a first and a second condition in accordance with the presence and absence of the input signal on said pair of input signal terminals, oscillating means connectable to said pair of d.c. supply terminals, gating means connected to said oscillating means, and d.c. making means connectable to said pair of d.c. supply terminals, and said oscillating, gating and d.c. making means controlled by the second condition of said switching means for providing a time delay period between the disappearance and the reappearance of the input signal on said pair of input signal terminals prior to said switch means reassuming the first condition.

2. A fail-safe time delay circuit as defined in claim 1, wherein said detection means includes a relay having its coil coupled to said pair of input signal terminals and having an inhibit contact coupled to said oscillating means.

3. A fail-safe time delay circuit as defined in claim 1, wherein said switching means includes a relay having its coil connectable to said pair of input signal terminals through a front contact.

4. A fail-safe time delay circuit as defined in claim 1, wherein said oscillating means includes a programmable unijunction transistor which is connectable to said pair of d. c. supply terminals.

5. A fail-safe time delay circuit as defined in claim 1, wherein said gating means includes a silicon controlled rectifier which is gated by said oscillating means.

6. A fail-safe time delay circuit as defined in claim 1, wherein said d. c. making means includes an oscillator and a rectifier which are connectable to said pair of d. c. supply terminals.

7. A fail-safe time delay circuit as defined in claim 1, wherein a charging capacitor is connected to said pair of d. c. supply terminals.

8. A fail-safe time delay circuit as defined in claim 1, wherein said oscillating means includes a first timing network having a time constant which is related to a time constant of a second timing network connectable to said switching means.

9. A fail-safe time delay circuit as defined in claim 8, wherein said first and second timing networks include ganged resistances.

10. A fail-safe time delay circuit as defined in claim 7, wherein said charging capacitor is discharged through said switching means when said gating means is triggered by said oscillating means.

* * * * *